United States Patent [19]

Camos

[11] 4,311,450

[45] Jan. 19, 1982

[54] DEVICE FOR LIMITING THE GAS FLOW IN A DISCHARGE VALVE FOR GAS LIGHTERS AND METHOD

[75] Inventor: Arturo Camos, Magenta, Italy

[73] Assignee: SAFFA S.p.A, Milan, Italy

[21] Appl. No.: 80,345

[22] Filed: Oct. 1, 1979

[30] Foreign Application Priority Data

Apr. 13, 1979 [IT] Italy ..... 21855 A/79

[51] Int. Cl.[3] ..... F23D 13/04

[52] U.S. Cl. ..... 431/344; 431/142; 222/3; 222/545; 251/118

[58] Field of Search ..... 431/344, 130, 131, 143, 431/142, 150, 254, 255, 276, 277; 222/3, 545, 547; 251/118, 123

[56] References Cited

U.S. PATENT DOCUMENTS 2,616,161 11/1952 Reilly ..... 431/344

3,050,973 8/1962 Goddard ..... 251/118

3,085,412 4/1963 Mohr et al. ..... 431/254

3,695,819 10/1972 Tricot ..... 431/344

FOREIGN PATENT DOCUMENTS 1287003 8/1972 United Kingdom ..... 431/344

*Primary Examiner*—Samuel Scott

*Assistant Examiner*—Lee E. Barrett

[57] ABSTRACT

The device for limiting the gas flow in a discharge valve for gas lighters for cigarettes of this invention comprises a portion (13) of reduced cross-section of the porous dipping element (7) which transfers by capillarity the liquefied gas from the tank to said valve. In this portion the fibers forming the porous dipping element (7) are so compressed with respect to the remainder portion of said porous dipping element (7) as to reduce the gas flow to a preset value corresponding to the maximum desired flame height.

1 Claim, 6 Drawing Figures

DEVICE FOR LIMITING THE GAS FLOW IN A DISCHARGE VALVE FOR GAS LIGHTERS AND METHOD

This invention relates to gas lighters and more particularly to a device for limiting the gas flow in a discharge valve of said gas lighters and a method of obtaining such a device.

Although gas lighters may or may not be provided with a flame height adjusting means to be operated by the user, they are generally provided with at least a filter limiting the flame height to a lower value than the maximum height permissible for security purposes. This filter is formed of a porous material such as fibers or foam and means are provided to adjust in the mounting operation the compression of such a filter according to the maximum desirable flow.

These means are comprised both of screwed elements which can become inaccessible to the user after the lighter is mounted, and of stop or similar elements limiting the stroke of the tools for mounting and for deforming (calking) the pieces forming the valve, and of shoulders limiting the angular movement of the adjusting nut of the lighter. (See French patent No. 75.18161)

In any case all of these means will presume a regulation or adjustment operation carried out during the mounting operation according to the actual flame height after the gas has been admitted into the tank.

The object of this invention is to overcome the disadvantages due to these adjustments by simplifying the design and assembly of the discharge valve and accordingly to decrease the manufacturing costs.

More particularly this invention is directed to a gas flow limiting device in a discharge valve for gas lighters for cigarettes, characterized in that it comprises a portion of reduced cross section of the porous fuel dipping element which transports by capillarity the liquefied gas from the tank to the valve, in which portion fibers forming said porous dipping element are compressed with respect to the remainder portion of said dipping element so as to reduce the gas flow to a preset value corresponding to the maximum desired flame height.

The invention comprises also a method of obtaining the above mentioned gas flow limiting device, which is characterised in that it comprises the steps of covering the porous dipping element by means of a jacket of deformable material and permanently deforming said jacket so as to reduce the cross-section thereof in the portion in which the fibers of the porous dipping element are to be compressed.

To this purpose of fuel dipping element is used which is adapted to transport the liquefied gas by capillarity with the best characteristics of compatibility with the gas. Materials which can be used to this purpose are polyamide (nylon) or polyester resins.

This dipping element having such porosity characteristics as to permit a gas flow greater than that required by the maximum flame height, is partially or totally covered by means of a jacket of malleable material, such as aluminium, which can be deformed at the final portion towards the valve in such a way as to produce a desirable pressing of the porous material. The porous material is pressed to reduce the gas flow to said predetermined value so as to limit the maximum flame height to the desired value.

The deformation of the jacket is carried out on the dipping element before the assembly of the lighter and the calibration value is controlled during the deformation by means of a suitable apparatus for measuring the flow of the fluid flowing through the porous material while it is pressed.

The measuring apparatus can be desirably comprised of a flowmeter operating with pressurized air or any other means designed to determine the calibration according to a preset flame height, and wich can be interlocked with the control of the deformation apparatus at the time that the calibration of the flow reaches the preset value.

Advantageously the deformation attains this purpose if it is obtained in such a manner as to cause a uniform reduction of the cross-section along a portion of variable length. It is possible however to set in advance the length of the portion of jacket to be deformed and to carry out the deformation in a radial direction until the necessary reduction of cross-section is attained.

The calibrated dipping element can be mounted upstream of the discharge valve of lighters of common design, namely lighters provided with flame adjustment, or directly in the valve of lighters without flame adjustment.

The invention will be better understood from the following detailed description, given merely by way of example and therefore not intended in a limiting sense, of two embodiments thereof in connection with the accompanying drawings, wherein.

Figure 1:
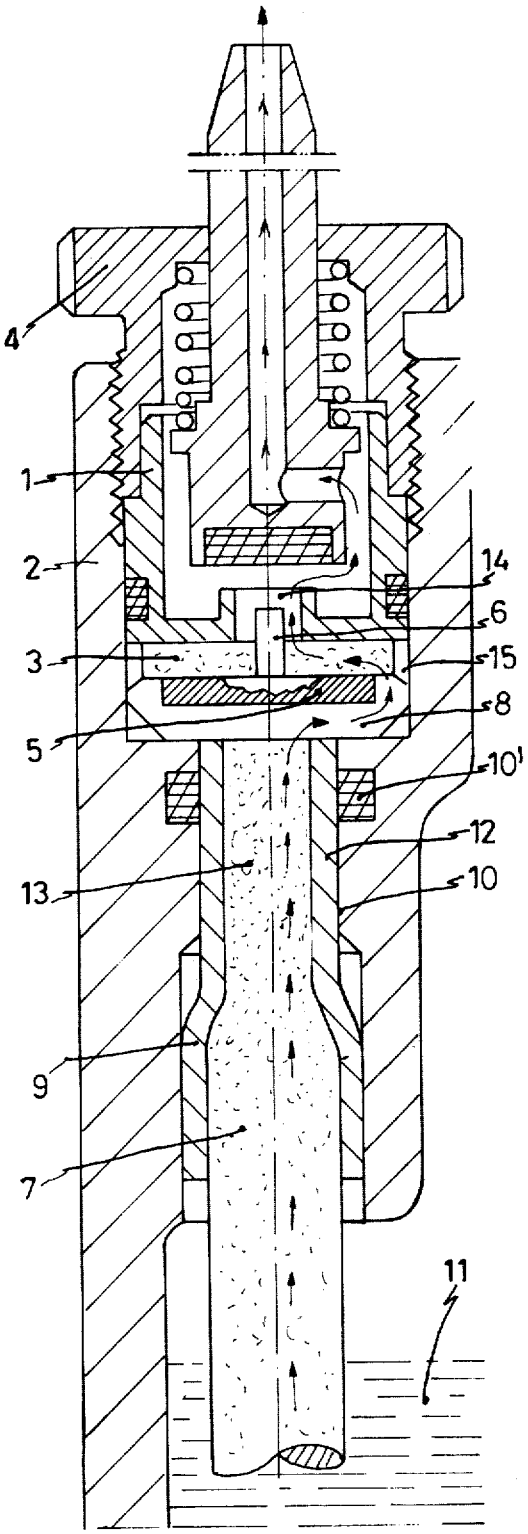
FIG. 1 is an axial section of a valve for a gas lighter having an adjustable flame height, provided with the gas flow limiting device according to this invention.

Referring first to FIG. 1, there is illustrated a discharge valve comprising an adjusting member 1 inserted in the valve housing 2 forming a part of the lighter body.

A leakage pad 3 can be compressed and released by screwing or unscrewing respectively a nut 4 extending from the lighter and therefore accessible to the user. The pad 3 bears on a plate 5 which assures the centering of the pad by means of a center pin 6 and permits the flow of gas from the porous dipping element through passages 8 and a chamber 15.

The porous dipping element 7 is partially covered by a jacket 9 of malleable metal, for example aluminium. The cover could also extend throughout the element 7.

The connection between the outer surface of the jacket 9 and the seat 10 of the housing 2 is provided by a sufficient mechanical force-fit so as to prevent the gas from flowing to the exterior of the jacket 9 towards the chamber 14. This flow can be prevented also by means of a gasket 10' or by the interposition of a deformable and resilient material of other type. This is made necessary because the primary function the porous dipping element 7 is to transfer by capillarity the liquefied gas 11 from the tank and to convey it in a liquid phase up to the pad 3.

A suitable deformation of the end portion 12 of the jacket 9 causes a calibrated flow of gas through the end portion 13 of the porous dipping element 7.

As the pad 3 is compressed so as to cause a lower gas flow than that permitted by the calibration of the porous dipping element 7, the flame height is obviously set by the flow permitted by the pad and the conversion into the gaseous phase occurs in the chamber 14 and downstream from the pad 3.

Therefore the flame adjustment is attained by changing the compression degree of the pad 3 by screwing or unscrewing the nut 4 so as to exert a greater or lower compression force on the pad by means of the member 1.

If the pad is no longer sufficiently compressed or is released and would permit per se a greater flow of gas than that of the calibrated value of the porous dipping element in the portion 13 the conversion into gaseous phase occurs directly in the portion 13 of the porous dipping element, in the passages 8 and in the chambers 15 and 14 and the flame height can no longer be increased since it is set by the calibrated flow in the porous dipping element in the portion 13. Therefore, the maximum flame height is exclusively dependent on the calibration of the portion 13 and the gas pressure inside the tank.

Figure 2:
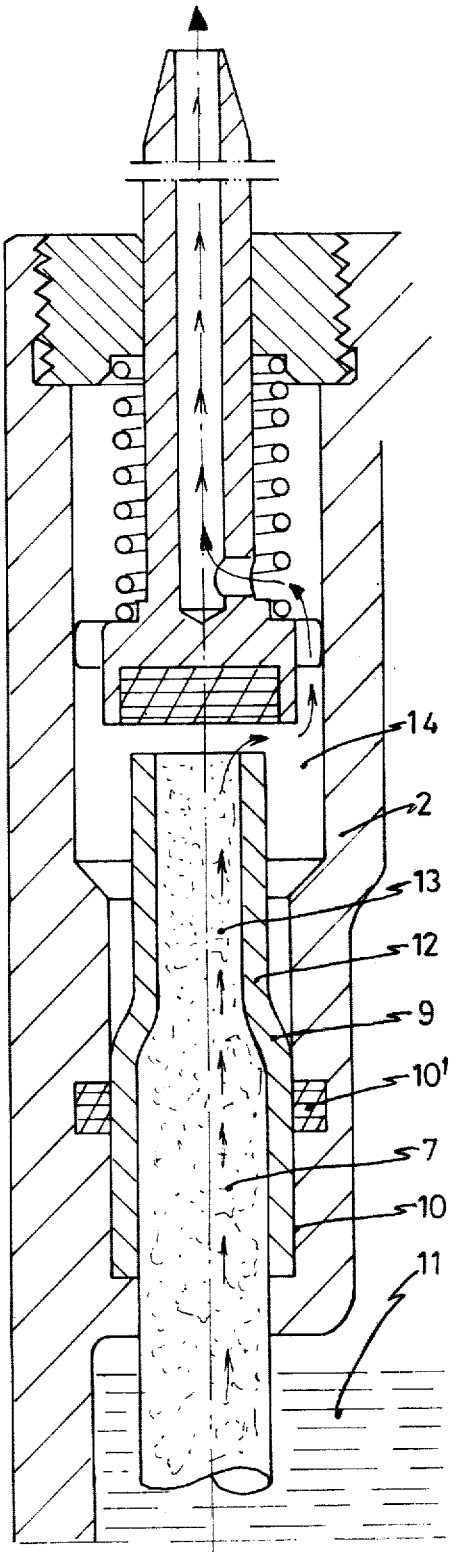
FIG. 2 is an axial section of a valve for a gas lighter without flame height adjustment, provided with the gas flow limiting device according to this invention.

The invention can be also applied to a discharge valve without flame height adjustment, as indicated in FIG. 2.

Also in this case the porous dipping element 7 is partially covered by a jacket 9 of malleable metal, such as aluminium. However, in this case the malleable metal covering could cover all the element 7.

The connection between the outer surface of the jacket 9 and the seat 10 in the housing 2 is provided by a sufficient mechanical forced fit so as to prevent the gas from flowing to the exterior of the jacekt 9 towards the chamber 14. This flow can be prevented also by means of a gasket 10' or by the interposition of a deformable and resilient material of other type.

This is made necessary because the primary function of the porous dipping element 7 is to convey by capillarity the liquefied gas 11 from the tank and to transport it in liquid phase up to the calibrated portion 13.

Therefore the transformation from liquid to gaseous phase occurs directly in the portion 13 of the porous dipping element 7 and in the chamber 14.

A suitable deformation of the end portion 12 of the jacket 9 provides a calibrated flow of gas through the end portion 13 of the porous dipping element.

Therefore, the limitation of the height of fixed flame is provided by the calibrated flow of the porous dipping element in the portion 13. The maximum flame height is therefore dependent exclusively on the calibration of the portion 13 and the gas pressure inside the tank.

In both cases the calibration of the portion 13 of the porous dipping element 7 is carried out before the introduction of said element into the lighter in particular cases, but in any case before the introduction of the gas into the lighter.

Figure 3:
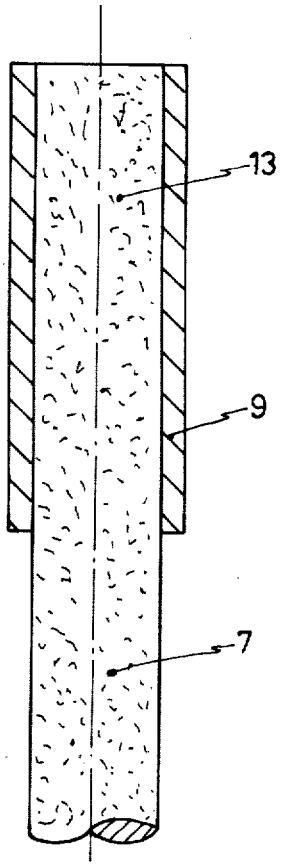
FIG. 3 is a fragmentary axial section of a fuel dipped porous element covered by means of a deformable jacket, according to this invention before the deformation operation.
Figure 5:
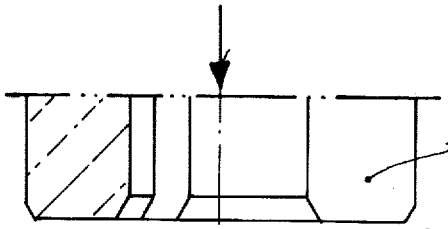
FIG. 5 is a diagrammatic fragmentary axial section of a movable die used for deforming the deformable jacket.

The porous dipping element 7 is covered by means of a jacket 9 of malleable metal, such as aluminium (see FIG. 3) of constant cross-section, for example of cylindrical shape.

The porous dipping element 7 is introduced in a suitable apparatus, not shown, capable of measuring the flow of a fluid flowing through the portion 13 of the dipping element 7.

Figure 4:
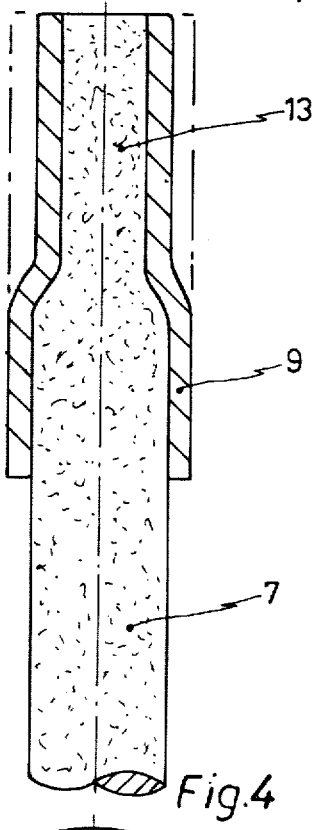
FIG. 4 shows the same element after the deformation operation.
Figure 6:
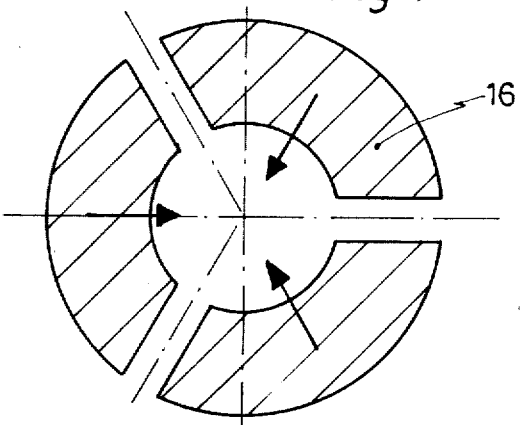
FIG. 6 is a fragmentary, diagrammatic cross-section of the die of FIG. 5.

The jacket 9 is suitably deformed so as to obtain a constant cross-section, which is reduced in the portion 13 (see FIG. 4) in which the fibers of the porous dipping element 7 are suitably compressed so as to reduce the fluid flow.

The desired calibration of this flow is accomplished by progressively deforming the jacket 9. This deformation can take place either by setting the cross-section to which the jacket is to be deformed or by setting the length of the jacket to be deformed. In either cases the amount of deformation is not present, but is a function of the fluid flow effectively measured by means of a suitable apparatus. The deformation is carried out by means of a movable die 16, the deforming action of which either in the case the cross-section of the jacket or in the case the length of the jacket are preset, is interlocked in a manner not shown with the flow measuring apparatus which stops the action of the die as the fluid flow through the portion 13 of the porous dipping element 7 reaches the preset value corresponding to such a gas flow as to cause the maximum desired flame height when the element 7 will be assembled into the lighter.

While two embodiments only of the invention have been shown and described, it should be understood that various changes and modifications can be made thereto without departing from the scope of the invention.

I claim:

1. A method of making a device for permanently limiting the gas flow in a discharge valve for lighters for cigarettes, said device comprising a housing;

a tank mounted in said housing and filled with liquified gas;

a porous longitudinal element having one end dipped into said tank to transfer said gas by capillary action to said discharge valve;

a jacket encompassing said porous element to form a combined unit mounted in said housing;

said method comprising the steps of:

introducing said combined unit prior to mounting it in said housing in an apparatus capable of measuring the flow of said gas through said unit;

interlocking said apparatus with a die adapted to neck down said combined unit so that the length of said unit which is necked down corresponds to the flow of said gas measured by said apparatus;

subjecting said combined unit to a necking down action by moving said die along said unit starting from an end thereof while gas is flowing through said unit;

stopping said necking down action when said gas flow reaches a value read at said apparatus providing a desired flame height and thereupon permanently setting said necked down portion; and subsequently mounting said premanently set necked down combined unit in said housing.

* * * * *